US005656003A

United States Patent [19]

Robinson et al.

[11] Patent Number: 5,656,003

[45] Date of Patent: Aug. 12, 1997

[54] LEG EXERCISE APPARATUS

[75] Inventors: Rey S. Robinson, Tampa; Vincent E. Mc Coy, Valrico; Glen H. Besterfield, Wesley Chapel, all of Fla.

[73] Assignee: McCoy & Robinson, Inc., Valrico, Fla.

[21] Appl. No.: 707,582

[22] Filed: Sep. 5, 1996

Related U.S. Application Data

[60] Provisional application No. 60/003,301 Sep. 6, 1995.

[51] Int. Cl.[6] ..... A63B 21/00

[52] U.S. Cl. ..... 482/93; 482/100; 482/98

[58] Field of Search ..... 482/94, 98, 93, 482/101, 96, 142, 145, 95, 135; 273/55 R

[56] References Cited

U.S. PATENT DOCUMENTS

| | | | |
|---|---|---|---|
| 2,475,289 | 1/1949 | MacGregor | 482/142 |
| 3,614,097 | 10/1971 | Bickman . | |
| 3,743,282 | 7/1973 | Zinkin . | |
| 4,357,011 | 11/1982 | Voris | 482/98 |
| 4,577,861 | 3/1986 | Bangerter et al. . | |
| 4,624,457 | 11/1986 | Silberman et al. | 482/98 |
| 4,720,103 | 1/1988 | Palladino, Jr. | 273/55 R |
| 4,781,372 | 11/1988 | Mc Cormack . | |
| 4,911,435 | 3/1990 | Johns . | |
| 4,915,378 | 4/1990 | Abrahamian . | |
| 5,013,039 | 5/1991 | Cole | 273/55 R |
| 5,058,884 | 10/1991 | Fuller, Sr. | 273/55 R |
| 5,224,909 | 7/1993 | Hamilton . | |
| 5,279,530 | 1/1994 | Hess . | |
| 5,383,831 | 1/1995 | Drath | 482/98 |

*Primary Examiner*—Jerome Donnelly
*Attorney, Agent, or Firm*—C. Douglas McDonald, Jr. & Associates, P.A.

[57] ABSTRACT

A weight training apparatus is particularly designed to exercise the lower limbs, and primarily intended to improve a track athlete's performance from the starting blocks. The apparatus includes independent, adjustable sliding foot supports that are coupled to a resistance mechanism. The athlete faces a shoulder support with his or her shoulders against the support and places his or her feet on the foot supports, such that pushing on each foot mount causes force to be transferred between the shoulder support and the corresponding foot supports.

18 Claims, 3 Drawing Sheets

LEG EXERCISE APPARATUS

RELATED APPLICATION

This application claims the benefit of U.S. Provisional Patent Application No. 60/003,301 filed Sep. 6, 1995.

BACKGROUND OF THE INVENTION

The present invention generally relates to weight training devices, including those particularly adapted for exercise of the lower limbs and especially to apparatus to assist an athlete in developing a fast start for running.

Numerous types of leg exercise devices have been developed to exercise an individual's legs in a variety of ways. Many conventional leg press exercising devices are characterized by a stack of weights, a seat, stool or bench facing the weight stack, and a set of foot pedals interposed between the seat and weight stack and interconnected to the weight stack so the movement of the pedals toward the weight stack raises it. These devices strengthen the lower limbs, but do not target and tone the muscles for the particular task of track running and, more specifically, the track start. When a track athlete as well as other types of athlete, such as a football player, is in a starting stance in preparation for the start of a race or a play, the individual's upper torso is substantially horizontal and is typically supported in part by at least one of the individual's arms. Upon indication to begin, the athlete thrusts forward and upward by pushing on the starting blocks or the ground to re-orient his body from the generally horizontal starting position to a generally upright running position. A quick and explosive transition from the starting position to the generally upright running position is essential in track as well as a variety of other sports. The numerous leg exercise devices that have been developed thus far fail to completely satisfy the needs of these athletes to develop the desired quick start.

SUMMARY OF THE INVENTION

In view of foregoing, it is an object of the present invention to provide an improved weight training device, especially suited for the training of track athletes. More specifically, it is an object to provide a device that is designed to improve performance by utilizing the muscles in the same way as an athlete does when coming out of track starting blocks or from a standard starting position. It is also desired to provide an apparatus for strengthening and developing the muscles to provide a proper forward and vertical motion from a starting position. In order to address the foregoing objects and others that will become apparent to those skilled in the art, the present invention is directed to a leg exercise apparatus that includes a base having a first and second end and a pair of substantially horizontal guides attached to the base second end, with each guide extending generally parallel to and spaced apart from the other guide and fixed generally intermediate the first and second ends of the base. Two foot supports are slidably mounted to one of the guides proximal the base second end, such that the foot supports are constrained to move independently along the respective guide to which it is mounted. A shoulder support is attached to the base proximal the base first end and spaced a predetermined distance above the base. The shoulder support is dimensioned and configured for engaging the front portion of the shoulders of a user above the base distal the foot supports, whereby a user may be positioned between the shoulder support and the foot supports and individually slide each foot support rearwardly to exercise his or her legs, with the upper body of the user supported in a generally horizontal position above the base. A resistance is connected to each foot support to provide force to resist the movement of each foot support as it is urged from its rest position towards the second end of the base and as each foot support is returned to its corresponding rest position.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION

Figure 1:
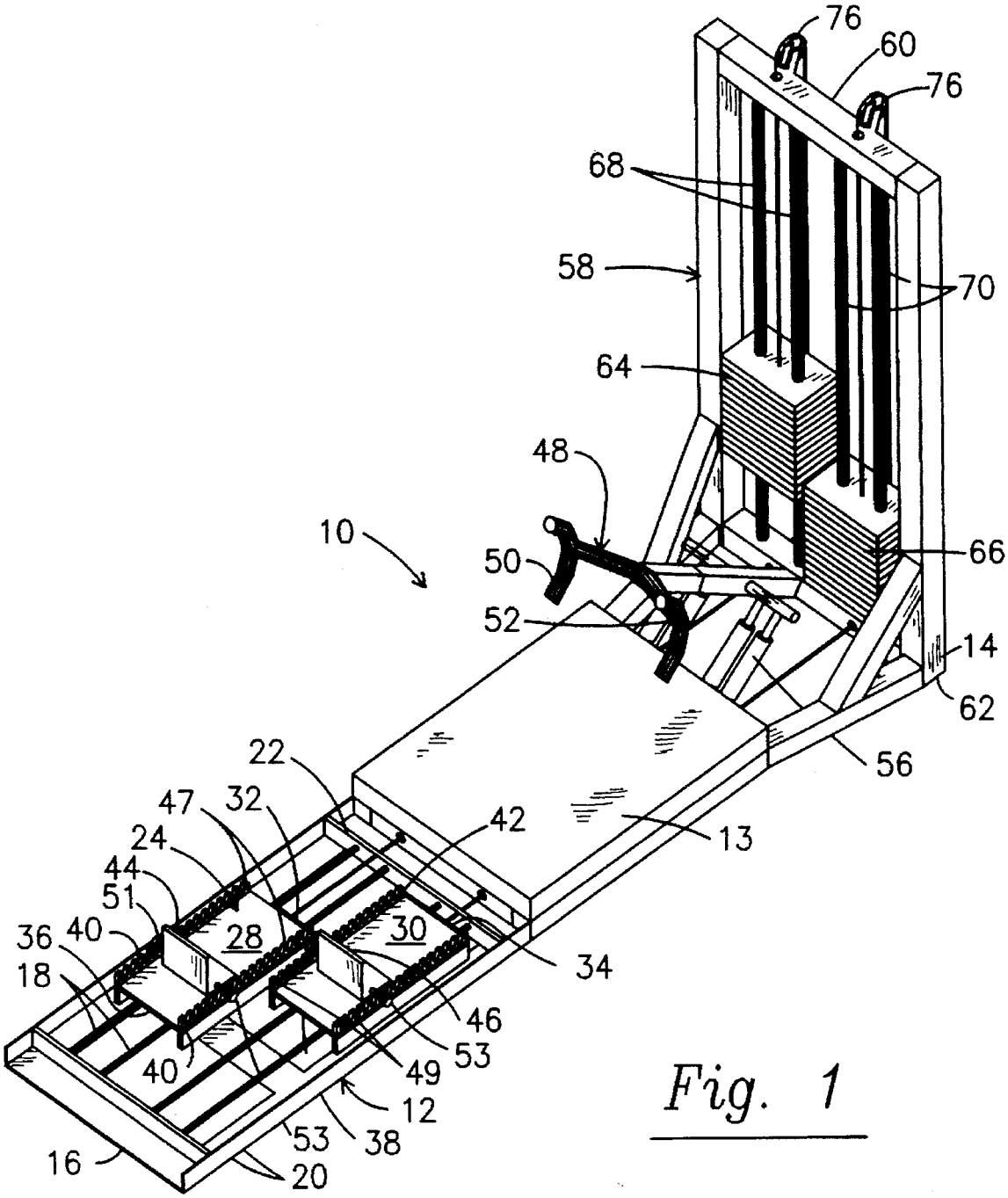
FIG. 1 is a perspective view of a preferred embodiment of an exercise apparatus in accordance with the present invention.

FIG. 1 illustrates a preferred embodiment of the exercise apparatus of the present invention, generally indicated as 10. Similar reference characters refer to similar parts throughout the several views of the drawings. The apparatus 10 includes a generally horizontal base 12 having first and second ends 14 and 16, respectively. A support platform 13, which may conveniently be a foam pad covered with leather, vinyl or other materials known in the art, is attached to the base 12 intermediate base first and second ends 14 and 16. Platform 13 facilitates the positioning of a user within the apparatus 10, as well as enables the user to get into a proper starting stance when using apparatus 10. A guide structure, suitably comprising two pairs of substantially horizontal guides 18 and 20, suitably formed of rigid material such as steel or the like, are attached to the base second end 16, with each pair of guides extending generally parallel to, and spaced apart from the other pair of guides between base second end 16 and support platform 13. In the preferred embodiment illustrated in FIG. 1, each of the pairs of guides 18 and 20 is fixed between the base second end 16 and intermediate support 22 that is positioned between the base ends 14 and 16 generally beneath platform 13. Foot supports 24 and 26 are slidably mounted to corresponding guides 18 and 20, respectively, such that each respective foot support 24 and 26 is constrained to move independently of the other foot support along its corresponding guides 18 or 20. Each foot support 24, 26 has a generally planar upper surface 28, 30, a first end 32, 34, a second end 36, 38 and a pair of generally opposed side edges 40, 42 extending between the first and second ends of each foot support 24 and 26, respectively. Each foot support 24, 26 also preferably includes a step 44, 46 extending generally transverse to the respective foot support upper surface 28, 30, suitably angled towards the base second end 16. In addition, each step 44, 46 is preferably adjustably attached, such as by the notched rails 47, 49 positioned along the foot support side edges 40, 42, respectively, to the respective foot support upper surface 28, 30 for positioning the steps 44 and 46 at a desired position between each foot support first end 32, 34 and each foot support second end 36, 38 in order to accommodate athletes of different height. In the preferred embodiment illustrated in FIGS. 1–3, spaced apart notches 47, 49 extend upwardly from each foot support upper surface 28, 30. Each step 44, 46 accordingly includes a protruding member 51, 53, respectively, that extends from each of its side edges and is configured to engage the selected pair of spaced apart notches 47 or 49, respectively. Protruding members 51, 53 conveniently enable a user to position each step 44 or 46 individually at a desired location along each foot support 24 or 26, respectively. In addition, the angle defined by each said step 44, 46 and foot support upper surfaces 28, 30, respectively, may also be conveniently adjusted as desired by the user, suitably between about 45 to about 90 degrees. Preferably, the foot supports 24 and 26 and steps 44 and 46 are dimensioned and configured as actual starting blocks, such as are used in track competition, giving the apparatus 10 a wide range of adjustments and versatility.

Figure 2:
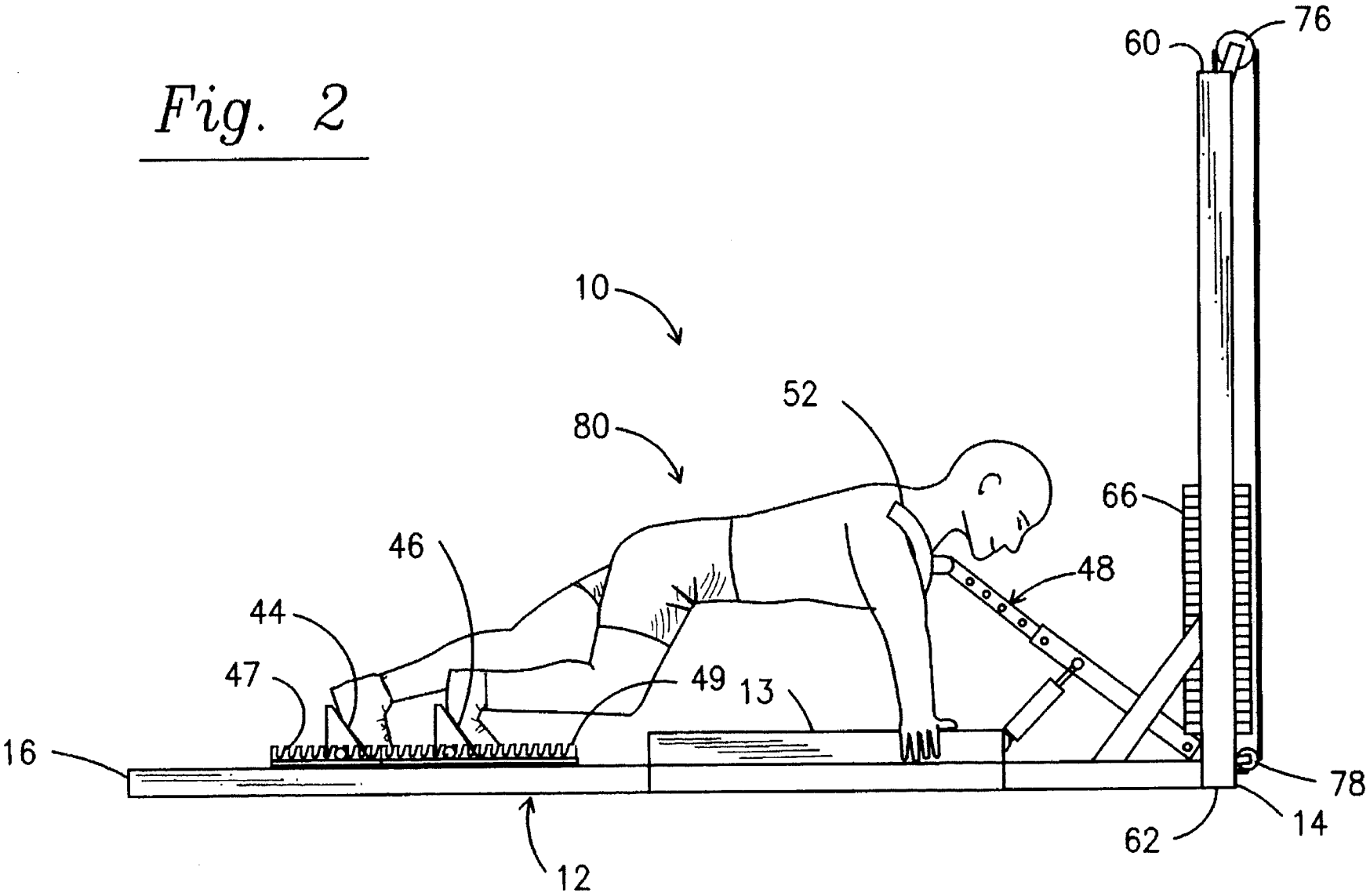
FIG. 2 is a side view of the apparatus of FIG. 1 in accordance with the present invention, illustrating a preferred method of use.
Figure 3:
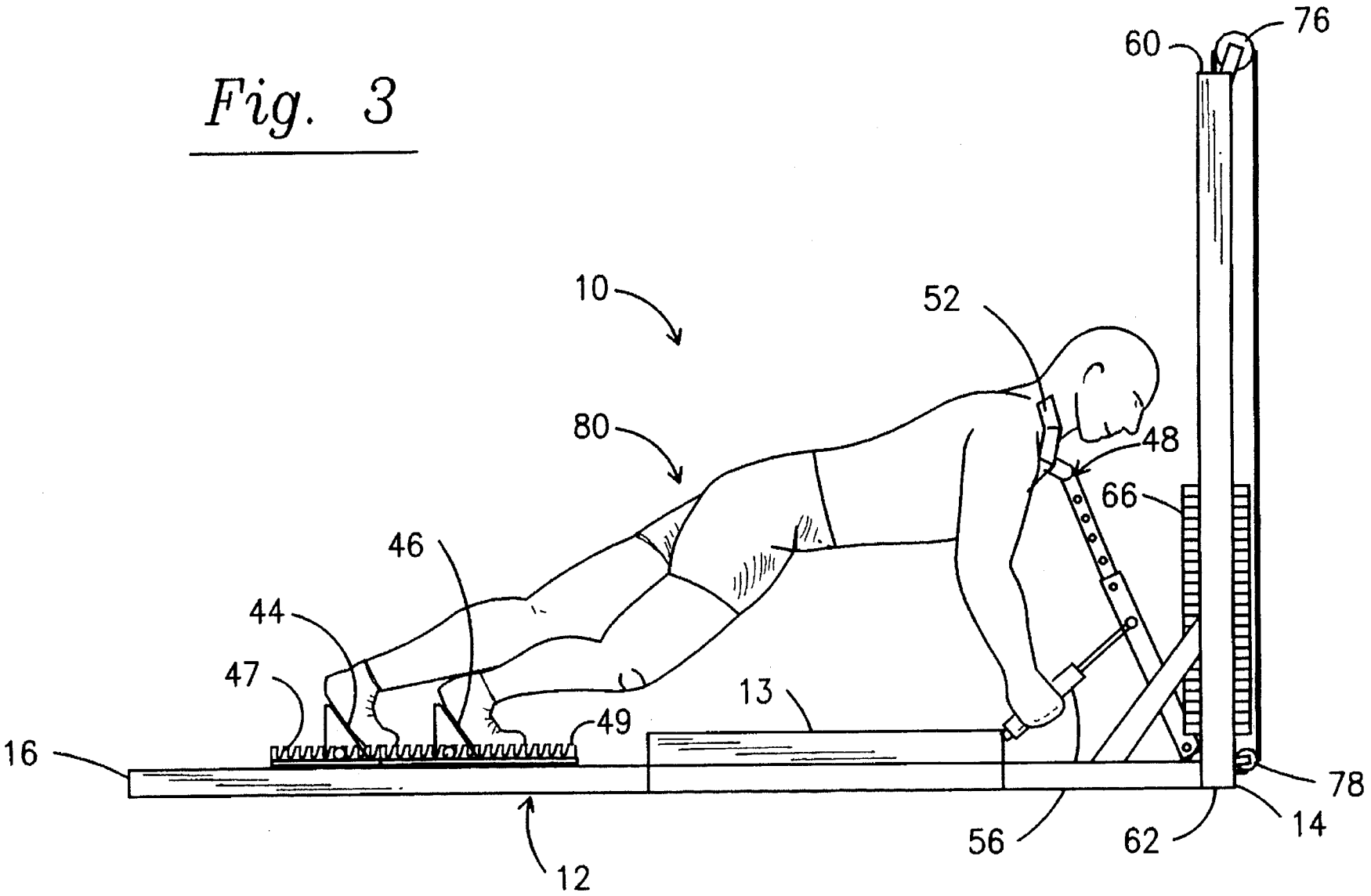
FIG. 3 is a side view of the apparatus of FIG. 1 similar to FIG. 2, illustrating a preferred method of use with the apparatus in an extended position.

A shoulder support, generally indicated as 48, is attached to the base 12 proximal to the base first end 14 and is spaced a predetermined distance above the base 12, and suitably may be adjusted to accommodate athletes of varying size. As illustrated in the preferred embodiments of FIGS. 1 and 2, shoulder support 48 is ergonomically designed and is dimensioned and configured for engaging the front portion of the shoulders of a user positioned proximal the base first end 14 and distal the foot supports 24 and 26. As such, the user may be positioned between the shoulder support 48 and the foot supports 24 and 26, as illustrated in FIGS. 2 and 3, and may slide each foot support, either individually or in unison, rearwardly to exercise the lower limbs, with the upper body of the user being supported generally horizontally above platform 13 generally by shoulder support 48. As illustrated in FIGS. 1, 2 and 3, shoulder support 48 preferably includes a pair of generally parallel and spaced apart support members 50 and 52 that are adapted and configured to receive the shoulders of the user when facing the base first end 14.

In order to accommodate athletes of different height, the shoulder support 48 is adjustable in a direction substantially transverse to and parallel to a plane defined by guides 18 and 20. In addition, each of the spaced apart support members 50 and 52 are preferably arcuate members that are connected to the base 12 proximal base first end 14 by an elongated arm 54 to engage the front portions of a user's shoulders facing the base first end. Preferably, arm 54 is pivotally attached to the base 12 proximal base first end 14 in a conventional manner and to the pair of spaced apart supports 50 and 52 and, such that the shoulder support 48 may rotate in its pivotal connection, upwardly and forwardly towards the base first end 14 when force is applied to shoulder support 48, thereby simulating the motion of an athlete exploding from a standard starting position. In order to assist an athlete to develop a more explosive start, a biasing element 56, which may conveniently comprise one or a plurality of dashpots or hydraulic cylinders or other forms of resistance known in the art, which may include resilient elements that return the biasing element 56 to its rest position, is connected between the base 12 distal base first end 14 and the shoulder support, suitably to arm 54, in order to provide resistance, similarly as a shock absorber, generally transverse to arm 54 during the upward and forward rotation of the shoulder support 48. In order to accommodate a plurality of such biasing elements 56, a cross support 57 may be attached to arm 54 substantially normal to arm 54 and to the direction to which arm 54 rotates. Accordingly, a plurality of such biasing elements 56 may be removably attached to cross support 57 and to base 12 distal base first end 14, such as, for example, by employing conventional rods or pins that may extend through the ends of each biasing element 56 and connect the ends of bias elements 56 to the cross support 57 and to base 12. Preferably, the amount of resistance that biasing element 56 provides against the upward and forward movement of the pivotally connected arm 54 may be adjusted by a user. This may be accomplished by adding or removing bias elements as well as by altering the amount of resistance that each biasing element 56 is capable of providing. In addition, the length of arm 54 should be adjustable by the user for positioning the shoulder support 48 at a desired predetermined height above the base 12. Thus, for the preferred embodiment illustrated in FIGS. 1–3, a preferred range of adjustment for arm 54 length positions shoulder support 48 between about one foot and about three feet above support platform 13.

Each foot support 24, 26 is connected to a conventional resistance mechanism that provides force resisting the movement of each foot support is urged from a rest position towards the base second end 16, and as the foot support 24 or 26 is returned to its rest position. The preferred implementation of resistance mechanism illustrated in FIGS. 1, 2 and 3 includes a generally vertical frame 58 extending upwardly from the base first end 14 with the resistance, suitably a pair of adjacent, adjustable weight stacks 64 and 66, positioned between the top end 60 the bottom end 62 of vertical frame 58. The pair of a adjustable weight stacks 64 and 66 may conveniently be fabricated of cast iron, steel or other materials known in the art, and each of which may be conveniently be supported within vertical frame 58 by respective pairs of substantially parallel and spaced apart vertical bars 68 and 70. The amount of resistance provided by each weight stack 64 and 66, indicated by the number of weights on respective weight stacks 64 and 66, is adjustable via, for example, cotter pins that may be inserted into each weight stack in a conventional manner. Weight stacks 64 and 66 are coupled to foot supports 24 and 26, respectively, such that urging a foot support 24 or 26 towards base second end 16 results in force being transferred to the respective weight stack 64 or 66, respectively, causing the selected portion of the corresponding weight stack 64 or 66 to move towards the vertical frame top end 60. In order to transfer the horizontal forces applied to foot supports 24 and 26 to the vertically oriented weight stacks 64 and 66, a plurality of rotatable supports, illustrated as pulleys 76 and 78, are attached to the vertical frame proximal vertical frame upper end 60 and vertical frame lower end 62. A connecting element 72, 74, suitably a cord, a chain or other appropriate connecting material known in the art, is connected to each foot support 24, 26 and extends through base 12 and engages the perimeter portion of the respective lower rotatable support 78, suitably a pulley or sprocket, which changes the direction of movement of the connecting element from horizontal to vertical. Each connecting element 72 and 74 then extends around the lower rotatable support 78 to the upper rotatable support 76, suitably a pulley or sprocket, and connects to the corresponding weight stack 64 and 66. Each of the rotatable supports 76 and 78 suitably includes a perimeter dimensioned and configured for receiving and engaging connecting elements 72 and 74 in order to efficiently transfer force between the foot supports 24 and 26 and the corresponding weight stacks to which they are attached. While FIGS. 1–3 illustrate a vertical weight stack positioned at base first end 14, other forms of resistance known in the art, including canes, springs, elastic members or other structures may be used and may be positioned at other locations on apparatus 10 without departing from the scope of the present invention.

With the preferred embodiment of the basic structure of this leg exercise apparatus having been described above, its preferred manner of operation may now be understood as follows. Referring to FIGS. 2 and 3, after appropriate adjustments have been made to the steps 44 and 46 and the shoulder support 48 to accommodate the athlete's individual height, the athlete 80 faces vertical frame 58 and braces each of his or her feet against the steps 44 and 46. At this time it may be convenient for the athlete 80 to place his knees on support platform 13 to facilitate positioning of his feet. Facing vertical frame 58, the athlete 80 positions his shoulders into engagement with spaced apart shoulder supports 50 and 52. Upon initiation of force against one or both of the foot supports 24 and 26, the athlete 80 will be raised from support platform 13, and substantially all of his force will be transferred between shoulder support 48, bias elements 56, foot supports 24 and 26 and weight stacks 64 or 66, enabling foot support 24, 26 to move accordingly. During the application of force by the athlete 80 to foot supports 24 or 26, shoulder support 48 moves in its pivotal connection upwardly and forwardly with respect to base 12 in accordance with the amount of resistance being applied by bias 56. The amount of rotation that arm 54 will experience depends on a variety of factors including, but not limited to, the amount of resistance being provided by bias elements 56, the amount of resistance provided by weight stacks 64 and 66 and the force that a user applies to foot supports 24 and 26. In general, bias 56 constrains the angular rotation of arm 54 between about 30 degrees and about 90 degrees, although typically less than about 90 degrees, with respect to the base 12. It is the upward and forward movement of shoulder support 48 in connection with the movement of foot supports 24 and 26 that simulates the movement of athlete 80 as he or she explodes from the starting blocks. By increasing the resistance in both bias 56 and weight stacks 64 and 66, exercising with apparatus 10 may strengthen certain muscles and develop a quick acceleration from a standard starting position, thereby enhancing starting speed and developing proper forward and vertical motion.

While the foregoing describes a particularly preferred embodiment of the apparatus of this invention, it is to be understood that this description and the illustration is indicative only of the principles of the invention and is not to be considered limitative thereof. Accordingly, because numerous variations and modifications of the invention, all within the scope of the invention, will readily occur to those skilled in the art, the scope of the invention us to be limited solely by the claims appended hereto.

What is claimed is:

1. A leg exercise apparatus comprising:

a base having a first end and a second end;

a pair of substantially horizontal guides attached to said base second end, each said guide extending generally parallel to and spaced apart from the other said guide and generally intermediate said first and second ends;

a pair of adjacent foot supports, each said foot support being slidably mounted to one of said pair of guides proximal said base second end such that said foot supports are constrained to move independently along the respective said guide;

a shoulder support pivotally attached to said base proximal said base first end and spaced a predetermined distance above said base proximal said base first end, said shoulder support dimensioned and configured for engaging the front portion of the shoulders of a user above said base proximal said base first end and distal said foot supports, said shoulder support being pivotally attached to and spaced apart from said base proximal said base first end, such that when force is applied to said shoulder support, said shoulder support rotates upwardly and forwardly toward said base first end, whereby a user may be positioned between the shoulder support and the foot supports and individually slide each foot support rearwardly to exercise with the upper body of the user supported by the shoulder support in an upward and forward movement a biasing element connected between said shoulder support and said base to provide resistance to said shoulder support; and a resistance mechanism connected to each said foot support, such that said resistance mechanism provides force resisting movement of each said foot support as each said foot support is urged from a rest position toward said second end of said base and as each said foot support is returned to the rest position of the respective said foot support.

2. An exercise apparatus as claimed in claim 1 wherein said shoulder support comprises a pair of generally parallel and spaced apart support members, said support members adapted to receive shoulders of a user facing said base first end.

3. An exercise apparatus as claimed in claim 2 wherein said shoulder support is adjustable in a direction substantially transverse to said pair of horizontal guides.

4. An exercise apparatus as claimed in claim 3 wherein said shoulder support is adjustable in direction substantially parallel to said pair of guides.

5. An exercise apparatus as claimed in claim 2 wherein said spaced apart support members further comprise a pair of spaced apart arcuate members dimensioned and configured to receive a user's shoulders and said apparatus further comprises an arm having a length connected between said pair of arcuate members and said base proximal said base first end.

6. An exercise apparatus as claimed in claim 2 wherein said shoulder support further comprises an arm pivotally connected between said pair of spaced apart supports of said shoulder support and said base proximal said base first end such that said shoulder support, such that when force is applied to said shoulder support, said shoulder support rotates upwardly and forwardly toward said base first end, whereby a user is able to be positioned between said shoulder support and said foot supports facing the base first end and individually slide each said foot support rearwardly transferring at least some force between the foot support being slid and said shoulder support, causing the shoulder support and the upper body of the user to rotate upwardly and forwardly toward the base first end.

7. An exercise apparatus as claimed in claim 6 wherein said length of said arm is adjustable for positioning the shoulder support at a predetermined height above said base.

8. An exercise apparatus as claimed in claim 7 wherein said arm length is adjustable between about two feet and about four feet.

9. An exercise apparatus as claimed in claim 6 further comprising a biasing element connected between said base, distal said base first end, and said shoulder support to provide resistance generally transverse to said arm during said upward and forward rotation of said pivotally connected arm with respect to said base.

10. An exercise apparatus as claimed in claim 9 wherein said biasing element further comprises an adjustment to vary the amount of resistance to said upward and forward rotation of said arm.

11. An exercise apparatus as claimed in claim 10 wherein said biasing element and said pivotal connection of said arm collectively constrain the rotation of said arm between about 30 degrees and about 90 degrees with respect to said base second end.

12. An exercise apparatus as claimed in claim 7 wherein said biasing element comprises a hydraulic cylinder attached between said shoulder support and said base.

13. An exercise apparatus as claimed in claim 12 further comprising an elongated cross support attached substantially transverse to said arm intermediate said pair of spaced apart supports and said base, and wherein said biasing element further comprises a plurality of hydraulic cylinders, each said cylinder being removably attached between said arm cross support and said base.

14. An exercise apparatus as claimed in claim 1 wherein each said foot support further comprises a generally planar upper surface having a first end, a second end and a pair of generally opposed side edges between said first and second ends, with a step extending generally transverse to said upper surface.

15. An exercise apparatus as claimed in claim 14 wherein each said step is adjustably attached to said foot support upper surface for positioning at a predetermined position between said first and second ends of said foot support upper surface.

16. An exercise apparatus as claimed in claim 15 wherein each said step further comprises an adjustment for varying the angle of said step with respect to said foot support upper surface.

17. An exercise apparatus as claimed in claim 1 further comprising a support platform having first and second ends and a pair of sidewalls extending therebetween, said platform attached to said base with said platform first end positioned proximal said base first end and said platform second end positioned intermediate said first and second ends of said base, with at least a portion of said platform positioned below said shoulder support.

18. A leg exercise apparatus comprising:

a base having a first end and a second end;

a pair of substantially horizontal guides attached to said base second end, each said guide extending generally parallel to and spaced apart from the other said guide and generally intermediate said first and second ends;

a pair of adjacent foot supports, each said foot support having a step extending generally transverse to an upper surface thereof, with each said foot support being slidably mounted to one of said pair of guides proximal said base second end such that said foot supports are constrained to move independently along the respective said guide;

a shoulder support having a pair of spaced apart supports dimensioned and configured for engaging the front portion of the shoulders of a user above said base proximal said base first end and distal said foot supports;

an adjustable arm pivotally attached to said base proximal said base first end and attached to said shoulder support spacing said shoulder support a predetermined distance above said base proximal said base first end, said pivotal attachment of said arm permitting an upward and forward rotation of said arm with respect to said base;

a biasing element attached between said arm and said base distal said base first end to provide resistance generally transverse to said arm during said upward and forward rotation of said arm; and a resistance connected to each said foot support, such that said resistance provides force resisting movement of each said foot support as each said foot support is urged from a rest position toward said second end of said base and as each said foot support is returned to the rest position of the respective said foot support, whereby a user may be positioned between the shoulder support and the foot supports and individually slide each foot support rearwardly with force being transferred between the foot supports and the shoulder support, thereby causing the shoulder support to move upwardly and forwardly with respect to the base.

* * * * *